US005988476A

United States Patent [19]

Olerio

[11] Patent Number: 5,988,476

[45] Date of Patent: Nov. 23, 1999

[54] RACK SYSTEM FOR BACKPACK

[76] Inventor: Matthew D. Olerio, 30 Leatherleaf Trail, North Kingstown, R.I. 02852

[21] Appl. No.: 09/103,616

[22] Filed: Jun. 24, 1998

Related U.S. Application Data

[60] Provisional application No. 60/075,019, Feb. 18, 1998.

[51] Int. Cl.[6] ..... A45F 3/08

[52] U.S. Cl. ..... 224/630; 224/653; 224/655; 224/657; 211/186; 108/107; 312/351; 206/555; 206/214

[58] Field of Search ..... 224/653, 655, 224/657, 626, 629, 630, 645, 153; 211/186, 126.15, 151, 134; 312/351, 350, 312; 108/106, 107; 190/110, 9, 127; 206/555, 224, 214; 220/530, 528, 529, 554, 553

[56] References Cited

U.S. PATENT DOCUMENTS

| | | | |
|---|---|---|---|
| 1,031,821 | 7/1912 | Schwarzenbach . | |
| 2,517,757 | 8/1950 | Adlerstein | 190/9 |
| 2,792,980 | 5/1957 | Brown . | |
| 3,332,730 | 7/1967 | Rubin et al. | 211/126.15 |
| 3,464,565 | 9/1969 | Nevai | 211/186 |
| 4,491,258 | 1/1985 | Jones . | |
| 4,721,237 | 1/1988 | Leslie . | |
| 5,184,763 | 2/1993 | Blaisdell et al. . | |
| 5,411,192 | 5/1995 | Xiao . | |
| 5,562,236 | 10/1996 | Monzingo . | |
| 5,630,537 | 5/1997 | Sciacca . | |
| 5,702,011 | 12/1997 | Carroll | 211/186 |

FOREIGN PATENT DOCUMENTS

| | | |
|---|---|---|
| 3402077 | 8/1985 | Germany . |
| 2184002 | 6/1987 | United Kingdom . |

*Primary Examiner*—Linda J. Sholl
*Attorney, Agent, or Firm*—Richard C. Litman

[57] ABSTRACT

The present invention is a rack system for a backpack which is secured to the interior of a standard backpack, and is accessible by means of a zippered flap in the backpack. The rack system has rigid side walls with slots or brackets for receiving a plurality of shelves either slidably or by snap fit connections. The shelves are angled for appropriate distribution of the weight of materials that the wearer is carrying. Optionally, at least one shelf may be equipped with a hinged lid and divided into compartments for storage of small items such as pens, rulers, etc. The shelves allow for improved organization of the backpack which subsequently prevents materials from being damaged.

16 Claims, 6 Drawing Sheets

RACK SYSTEM FOR BACKPACK

CROSS-REFERENCE TO RELATED APPLICATION

This application claims the benefit of U.S. Provisional Patent Application Ser. No. 60/075,019, filed Feb. 18, 1998.

BACKGROUND OF THE INVENTION

1. Field of the Invention

The present invention relates generally to knapsacks and backpacks. More specifically, the invention is a rack system for holding books and the like in the interior chamber of a backpack that has a standardized exterior configuration.

2. Description of Related Art

Backpacks are utilized by people all over the world from kindergarten through graduate school. Throughout these years people are often required to transport large, heavy textbooks and notebooks back and forth to school each day. Standard backpacks consist of a zippered sack with a large empty cavity in which one places his books, notebooks and other large items. Although people attempt to organize the materials in an orderly fashion, it is virtually impossible to do so.

Additionally, when carrying heavy items, great strain is placed on the shoulders, neck and back of the person carrying the bag. This occurs primarily due to the fact that the large items are pulling down and back on the straps of the bag and the wearer must often lean forward to compensate for that force. The constant shifting of materials within the backpack also leads to discomfort and strain on the wearer.

What is needed is a backpack that provides a way to organize books and materials in such a way that they are easily accessible and placed in such a way that the weight of the material in the backpack is distributed to reduce the strain on the neck, shoulders and back of the wearer.

Backpacks and tote-bag organizers have been the subject of prior patents. U.S. Pat. No. 1,031,821 issued on Jul. 9, 1912 to Schwarzenbach discloses a backpack for use when camping that has space for several covered vessels. The vessels are simply placed in the opening within the backpack in an organized manner. Schwarzenbach does not teach the use of shelves in a backpack for better organization or weight distribution.

U.S. Pat. No. 2,792,980 issued on May 21, 1957 to Brown discloses a backpack with horizontal shelves sewn into the sides of the backpack and a zippered flap that allow access to the contents of the backpack when the backpack is placed in an upright position. The pack disclosed in Brown does not teach the use of angled shelves for better weight distribution, and furthermore, the shelves in the Brown device are fixedly secured to the sides of the backpack, precluding adjustment of the spacing between shelves to adapt for larger objects and substitution of special purpose compartmentalized shelves as in the present invention.

U.S. Pat. No. 4,491,258 issued on Jan. 1, 1985 to Jones discloses a convertible backpack. The three removably coupled sections of the backpack can be separated and used as bicycle panniers. Jones does not disclose the use of shelves within the backpack for organization or better weight distribution as in the present invention.

U.S. Pat. No. 4,721,237 issued on Jan. 26, 1988 to Leslie discloses a portable cooler for beverage cans. The cooler contains a box-like chamber with insulating material on its surfaces. The box-like chamber has a serpentine construction with horizontally elongated recesses adapted to hold beverage cans. The Leslie patent does not teach angled support shelves for organization or improved weight distribution.

U.S. Pat. No. 5,184,763 issued on Feb. 9, 1993 to Blaisdell et al. discloses a modular, free movement backpack system. The backpack has upper and lower modules which are connected by a ball joint to allow for free movement in order to reduce strain on the wearer's back. Blaisdell et al. does not teach the use of angled support shelves for organization of material or improved weight distribution.

U.S. Pat. No. 5,411,192 issued on May 2, 1995 to Xiao discloses a container having a folding table including a drink holder and a book holder. The container may have shoulder straps for a backpack configuration, a handbag strap, or it may be configured for suspension from an automobile seat. Xiao does not teach the use of any shelves, nor does it teach any means for improved weight distribution.

U.S. Pat. No. 5,562,236 issued on Oct. 8, 1996 to Monzingo discloses a modular backpack having upper and lower bags divided into zippered compartments which may be reconfigured into luggage or used as bicycle panniers. Monzingo does not teach the use of shelves for improved organization or weight distribution.

U.S. Pat. No. 5,630,537 issued on May 20, 1997 to Sciacca discloses a compartmentalized box and a knapsack incorporating the same. The compartmentalized box has a plurality of panels arranged in rows and columns for supporting a plurality of containers slidable in and out of the box. The panels can be rearranged to be adapted for different sized containers for use with fishing tackle and the like. The Sciacca patent does not teach the use of shelves for organization. The fact that containers must be used to store items in an orderly fashion limits the size and types of objects that can be stored. Lastly, Sciacca does not teach a means for improving weight distribution within the knapsack as in the present invention.

German publication No. DE 3,402,077, published on Aug. 1, 1985, discloses a convertible backpack for traveling on planes, trains, and the like, which is separable into a suitcase and handbags with carrying straps and hand grips. The patent does not teach the use of shelves for organization or weight distribution as in the present invention.

U.K. Patent No. 2,184,002, published Jun. 17, 1987, discloses three bags which strap together to form a rucksack, or which may also be used as a bicycle bag. It does not teach any means for improved organization or weight distribution.

None of the above inventions and patents, taken either singly or in combination, is seen to describe the instant invention as claimed.

SUMMARY OF THE INVENTION

The present invention is a rack system for a backpack which is secured to the interior of a standard backpack, and is accessible by means of a zippered flap in the backpack. The rack system has rigid side walls with slots or brackets for receiving a plurality of shelves either slidably or by snap fit connections. The shelves are angled for appropriate distribution of the weight of materials that the wearer is carrying. optionally, at least one shelf may be equipped with a hinged lid and divided into compartments for storage of small items such as pens, rulers, etc. The shelves allow for improved organization of the backpack which subsequently prevents materials from being damaged.

Accordingly, it is a principal object of the invention to provide a rack system for a backpack that is light weight and durable and provides a means for organizing materials and distributing the weight of the materials in such a way that strain on the back, neck, and shoulders of the wearer are significantly reduced.

It is a further object of the invention to provide a rack system for backpacks that is adapted for holding books and materials of varying sizes by providing a rack system with removable shelves.

Still another object of the invention is to provide a rack system for backpacks that is adapted for holding various school supplies.

Yet another object of the invention is to provide a rack system for backpacks having shelves with a greater surface area than horizontal shelves by mounting the shelves at a 45° angle.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
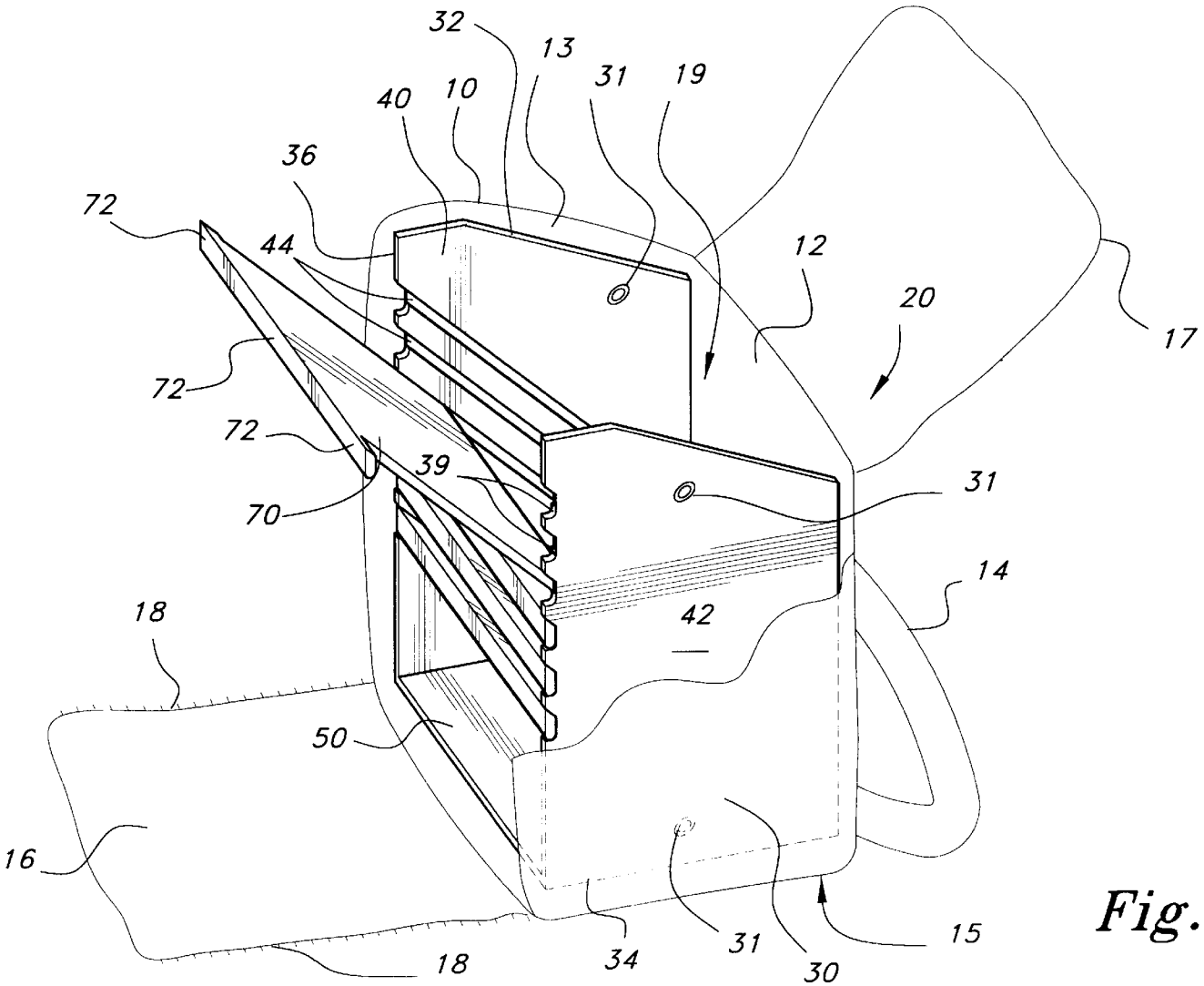
FIG. 1 is a perspective view of a rack system for backpack according to the present invention, showing backpack in phantom lines.

The present invention comprises a rack system 20 for backpacks that is secured to the interior of a backpack 10. The backpack 10 comprises a back wall 12 provided with carrying straps 14 thereon, a front wall 16 opposite said back wall 12, side walls 13, a bottom wall 15, and a top wall 17 or flap which define a cavity. The front wall 16 of the backpack 10 features an opening 18 defined therein provided with a zipper closure 19 extending from the top of the backpack 10 to within about two inches of the bottom of the backpack and for substantially the width of the backpack 10, permitting access to the cavity. The rack system 20 comprises a pair of rigid sidewalls 30, a base member 50, and a plurality of shelves 70, and is preferably constructed from an injection molded, high strength, lightweight synthetic polymer, such as polypropylene. The shelves 70 may be constructed from the same material as the base 50, presenting a uniform, solid surface, or may have a mesh or canvas surface.

In a first embodiment, each sidewall 30 has a top end 32 and a bottom end 34, a front edge 36, and an inner 40 and outer surface 42. The top end 32 is angled or canted to allow the rack system 20 to fit inside a standard backpack 10. The bottom end 34 of each sidewall 30 is connected with the flat base member 50, so that the sidewalls 30 are substantially vertical and parallel to each other, joined by a substantially horizontal base member 50 in order to define a U-shaped frame. The inner surface 40 of each sidewall 30 is provided with a plurality of grooves 44 therein, extending in a straight, continuous line for substantially the width of the sidewall 30 at an angle of 450 relative to horizontal. The grooves 44 are adapted for receiving shelves 70. On the front edge 36 of the sidewall 30 there are a plurality of notches 39 adjacent each groove 44. The notch 39 is adapted for receiving the shelf 70 as will be described herein below.

Each shelf 70 is a flat plastic sheet that insertably connects with either set of grooves 44 along the sidewalls 30 such that the shelf 70 extends perpendicularly relative to each of the sidewalls 30, and is oriented at a 45° angle to horizontal. Each shelf 70 is provided with a flange 72 projecting from the edges of the shelf 70 which engage the notch 39 adjacent to each groove 44 in order to prevent the shelf 70 from sliding out of the rack 20 by gravity.

The rack 20 is secured to the interior of the backpack 10 by any conventional means. The embodiment shown in FIG. 1 includes a plurality of holes 31 defined in the sidewalls 30 adapted for receiving a rivet securing the rack 20 to a backpack 10. The rack 20 may also be secured to the backpack by being sewn into the pack 10, by being inserted into a bag before insertion in the pack 10, by hook and loop fastener straps, etc. Preferably the back surface 12 of the backpack 10 is padded with ⅜" of foam padding to cushion the back from the edges of the rack 20.

Figure 2:
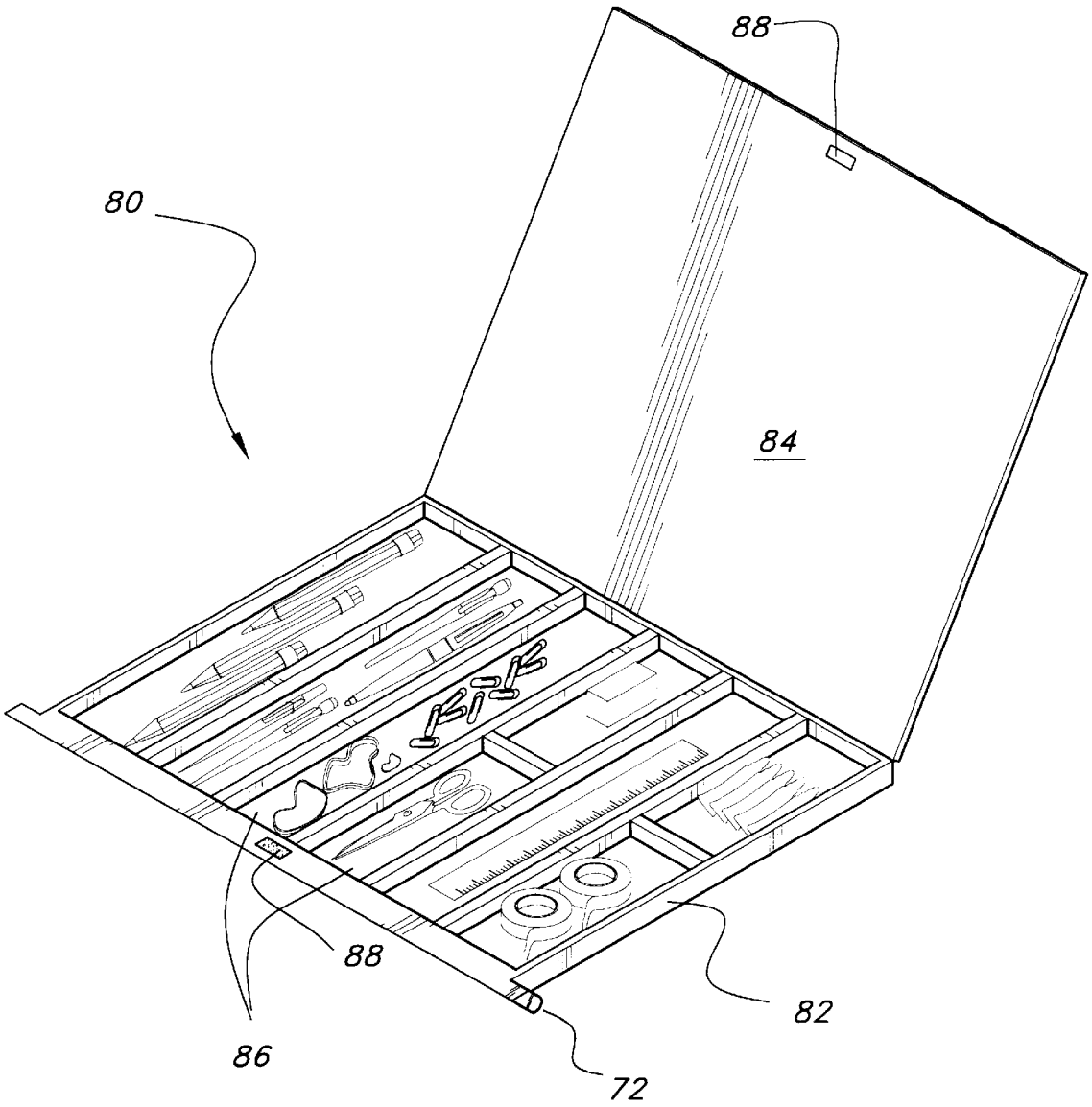
FIG. 2 is a perspective view of a material holding tray for use with the present invention.

In another embodiment of the invention, one of the shelves 70 comprises a material storage bin 80, as shown in FIG. 2, which bin 80 insertably engages the sidewalls 30 in the same manner as the shelves 70. The material storage bin 80 comprises a tray 82 provided with a plurality of compartments 86 defined therein and a lid member 84 which is hingedly attached to the tray 82. The lid 84 can be fastened to the tray by means of a hook and loop type fastener 88 or similar fasteners known to one skilled in the art.

Figure 3:
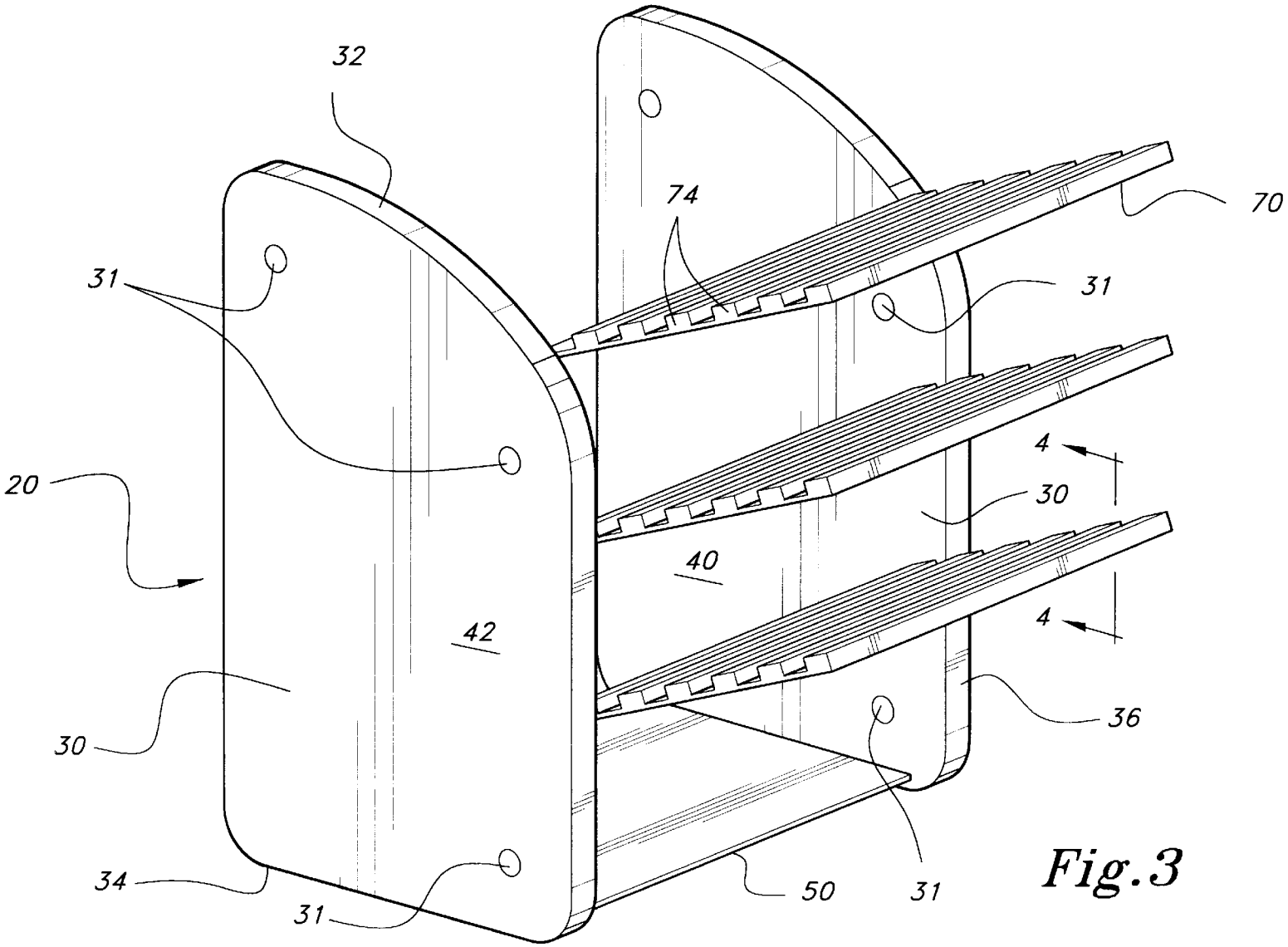
FIG. 3 is a perspective view of a third embodiment of the rack system showing shelves having ribs.
Figure 4:
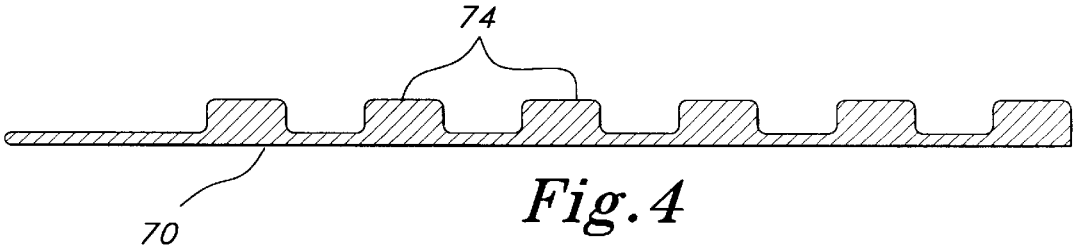
FIG. 4 is a sectional view along the line 4—4 of FIG. 3 showing a cross section of a shelf with ribs.

In a third embodiment of the invention, as shown in FIGS. 3 and 4, the shelves 70 include ribs 74 spaced over the width of the shelf 70 extending longitudinally for the length of the shelf 70. The ribs 74 add strength to the shelf 70. In this embodiment, it will be noted that the top ends 32 of the sidewalls 30 are sloped forward instead of rearward, and the shelves 70 do not include a flanges 72. Thus, the shelves 70 are retained in the rack 20 by friction between the shelves 70 and the sidewalls 30 and by cooperation with the back surface 12 of the backpack 10.

Figure 5:
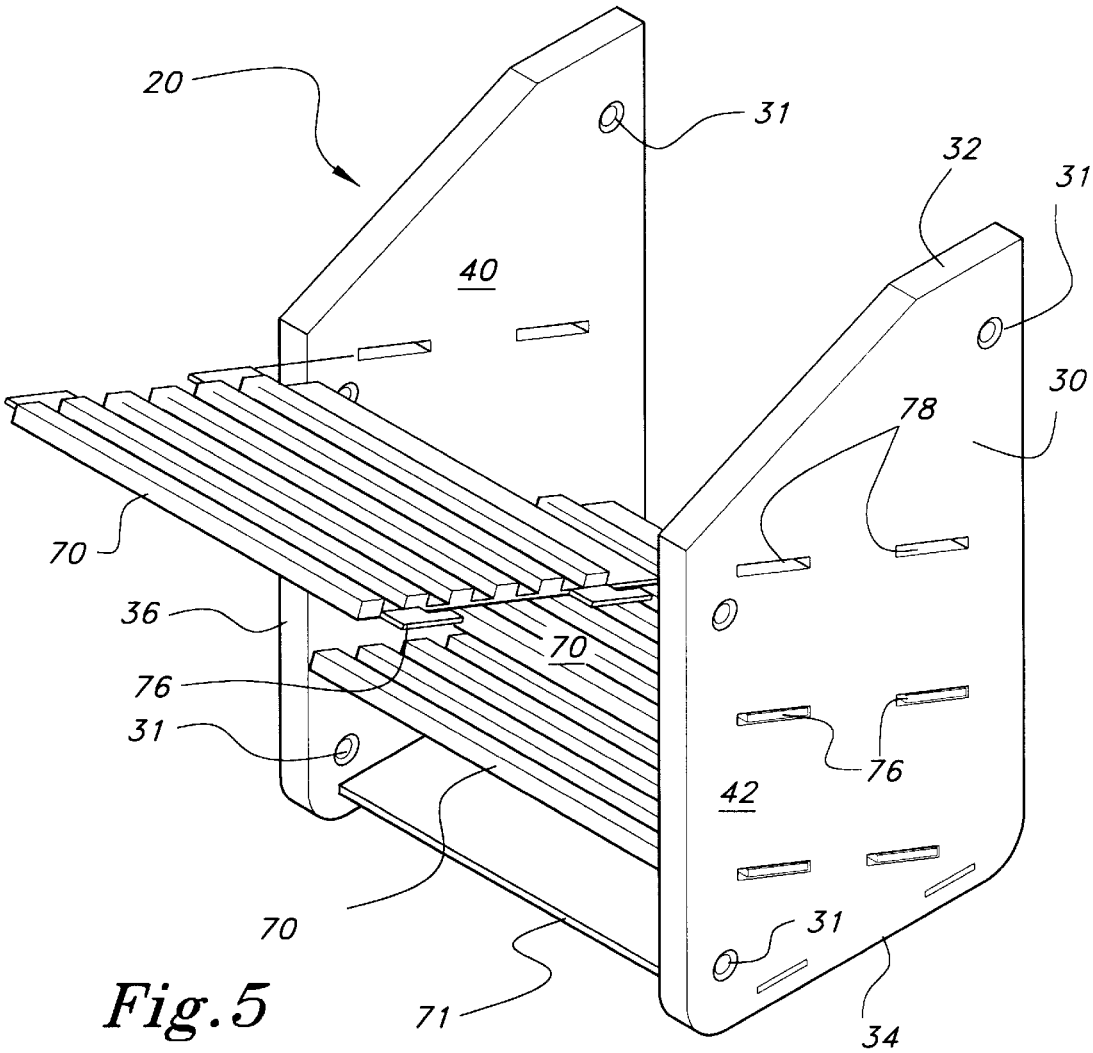
FIG. 5 is a perspective view of a fourth embodiment of the rack system showing shelves which snap into the sidewalls.

In a fourth embodiment of the present invention, as shown in FIG. 5 the shelves 70 have a pair of tabs 76 on each lateral edge of the shelf which snap into a corresponding pair of slots 78 defined in the sidewalls 30. Also shown in the fourth embodiment is a fourth shelf 71 positioned horizontally, which is substituted for the base member 50, somewhat smaller than the slanted shelves 70 and suitable for storage of smaller items.

Figure 6:
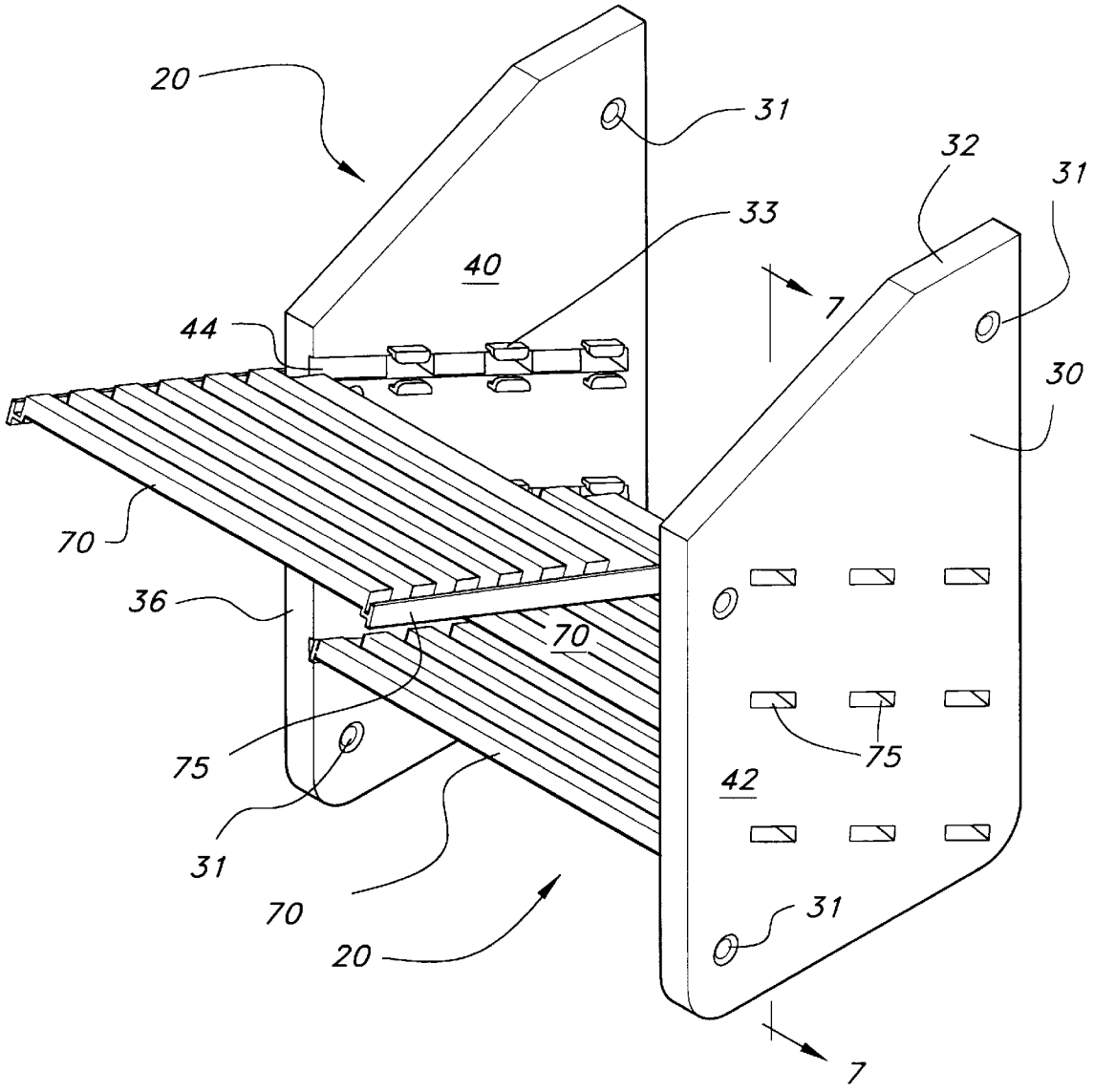
FIG. 6 is a side perspective view of a fifth embodiment of the rack system of the present invention showing T-connectors.
Figure 7:
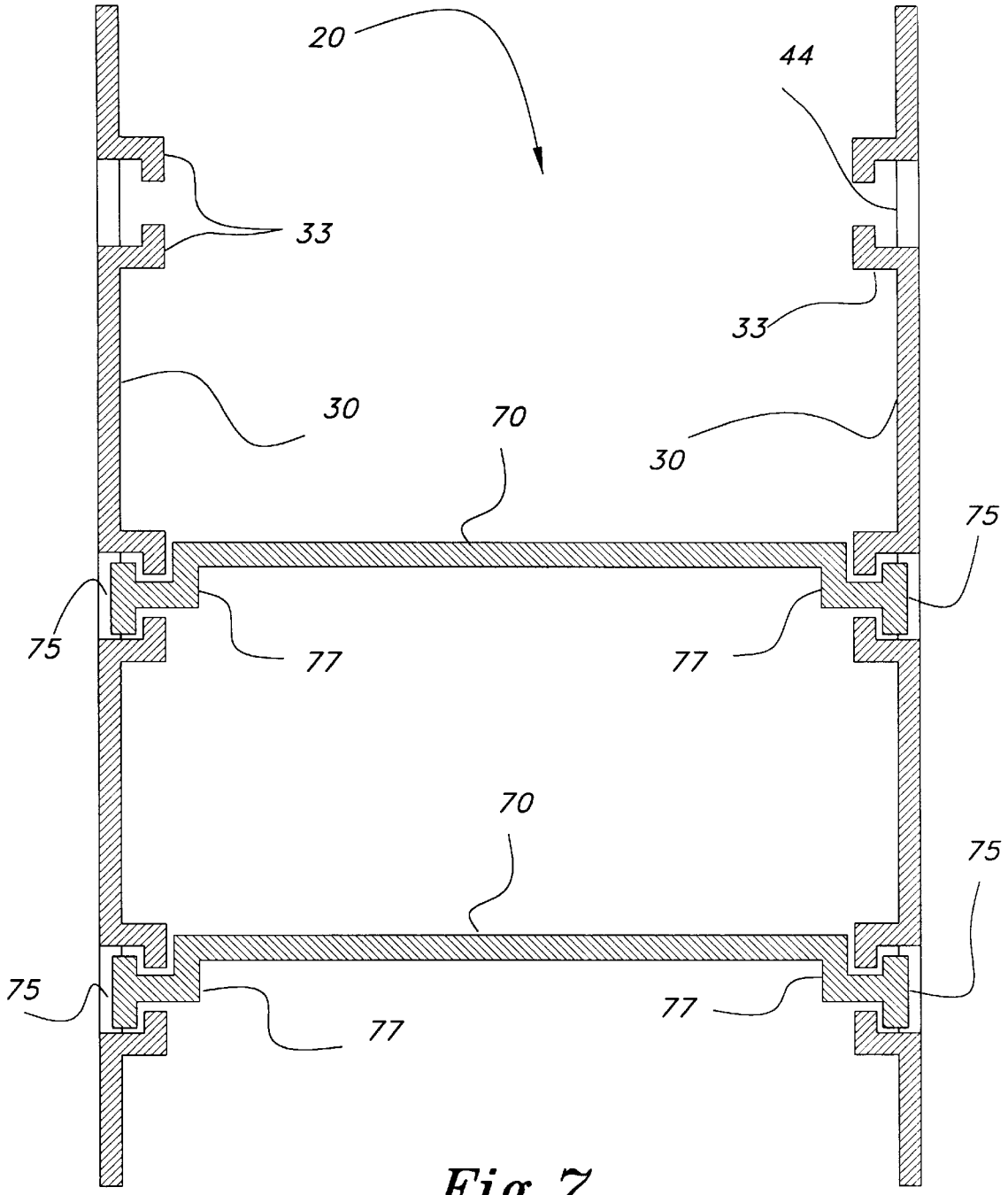
FIG. 7 is a sectional view of the embodiment shown in FIG. 6 along the line 7—7.

A fifth embodiment of the invention, shown in FIGS. 6 and 7, includes a plurality of brackets 33 mounted on the sidewalls 30 adapted for receiving shelves 70 having T-shaped male connectors 75 along their side edges. As shown most clearly in FIG. 7, the lateral edges of the shelves have a flange 77 projecting vertically downwards at a right angle to the shelf 70, and a T-shaped male connector 75 projecting outwardly from the edge of the flange 77 at a 90° angle, the stem of the T being supported by the brackets 33 and the crossbar of the T being supported by the groove 44 in the sidewall 30 between brackets 33. The shelf 70 is prevented from sliding completely through the groove 44 by friction between the T-shaped connector 75 and the brackets 33.

The rack system 20 is secured in the open cavity in the backpack 10 such that the front edge 36 of each sidewall 30 is facing the front surface of the backpack 10. Books and other materials are placed on the angled shelves 70 and the weight of the materials is distributed in such a fashion that the moment arm created about the wearer's shoulders, neck, and spine is less than it would be if the materials were simply placed in the empty backpack 10, thereby making the backpack 10 seem lighter to the wearer. The angle of the shelves 70 presents a larger surface area for the storage of items than a horizontal shelf in a backpack 10 of the same width. Additionally, the shelves 70 allow the materials to be organized in such a manner that the materials are easily retrieved and the damage to the materials such as text books and notebooks is significantly reduced.

It is to be understood that the present invention is not limited to the sole embodiments described above, but encompasses any and all embodiments within the scope of the following claims.

I claim:

1. A rack system adapted for disposition within the cavity of a backpack, the backpack including a back wall having a layer of foam padding and carrying straps, and a front wall having an opening defined therein provided with a zipper closure whereby when said zipper is opened, said front wall folds down to provide access to the cavity, said rack system comprising:

a) a pair of sidewalls, each sidewall having a top end, a bottom end, an inner surface and an outer surface, and a front edge, each sidewall further having a plurality of grooves defined in the inner surface of said sidewall, each groove extending in a continuous straight line for substantially the width of the sidewall at an angle of about 45° relative to horizontal, starting at the front edge of said sidewall and sloping downward;

b) a plurality of shelves, each shelf being substantially flat, each shelf being slidably disposed within the grooves between said pair of sidewalls so that each shelf defines an angle of about 45° relative to horizontal; and c) backpack attachment means for securely attaching the rack system to the backpack with the front edge of each said sidewall facing the front wall of the backpack, whereby said shelves slope downward toward the back wall of the backpack and said rack system is adapted for evenly distributing the weight of a load against the back wall of the backpack in order to relieve strain.

2. The rack system according to claim 1, wherein the top end of each said sidewall is canted in order that the rack system fits better within the cavity of the backpack.

3. The rack system according to claim 2, wherein said rack system is made from a substantially rigid, impact resistant synthetic polymer.

4. The rack system according to claim 3, wherein said synthetic polymer is polypropylene.

5. The rack system according to claim 1, wherein said backpack attachment means comprises a plurality of holes defined in said pair of sidewalls, each hole being adapted for receiving a rivet for connecting the sidewall to the backpack.

6. The rack system according to claim 1, further comprising a base member connected between the bottom ends of said pair of sidewalls, whereby said pair of sidewalls are disposed vertically and said base member is disposed horizontally therebetween in order to form a substantially U-shaped frame, and wherein:

a) each of said plurality of shelves has a flange projecting from the edges of the shelf; and b) each of said sidewalls has a plurality of notches defined in the front edge thereof, each notch being aligned with the intersection of one of said plurality of grooves and the front edge, said notch being adapted for receiving one of said flanges, whereby said shelves are grasped by said flange and slide within said grooves, and are prevented from sliding out of said grooves by said flange being received in said notches.

7. The rack system according to claim 1, wherein at least one of said plurality of shelves further comprises a material storage bin, said material storage bin having:

a) a tray having a plurality of compartments defined therein;

b) a lid for covering said plurality of compartments, said lid being hingedly attached to said tray; and c) a resealable fastener connected to said lid and said tray for fastening said lid to said tray.

8. The rack system according to claim 1, further comprising a base member connected between the bottom ends of said pair of sidewalls, whereby said pair of sidewalls are disposed vertically and said base member is disposed horizontally therebetween in order to form a substantially U-shaped frame, and wherein each shelf in said plurality of shelves includes a plurality of ribs spaced over the width of the shelf and extending longitudinally for the length of the shelf.

9. The rack system according to claim 1, wherein:

a) each shelf in said plurality of shelves has a pair of lateral edges, a flange protecting vertically downwards at a right angle from each of the lateral edges of said shelf, and further includes a T-shaped connector extending from the flange; and b) each of the sidewalls further includes a plurality of brackets adapted for receiving said T-shaped connectors, the stem of the T-shaped connector being supported by said brackets, the crossbar of the T-shaped connectors being supported by the grooves defined in the inner surface of said sidewalls, whereby said plurality of shelves removably slides between said pair of sidewalls and each said shelf remains disposed between said pair of sidewalls by friction between said brackets and said T-shaped connectors.

10. A backpack rack system comprising:

a) a backpack defining a cavity and including i) a back wall provided with carrying straps;

ii) a front wall opposite said back wall, said front wall having an opening defined therein provided with zippered closure, wherein when said zipper is opened said front wall folds down to gain access to said cavity;

iii) side walls connecting said front wall with said back wall;

iv) a bottom wall disposed between said front wall, said back wall, and said sidewalls;

v) a top wall connected to said back wall; and b) an insertable rack system dimensioned and configured to reside within said cavity closely against said backpack, including:

i) a pair of sidewalls, each sidewall having a top end, a bottom end, an inner surface and an outer surface, and a front edge, each sidewall further having a plurality of grooves defined in the inner surface of said sidewall, each groove extending in a continuous straight line for substantially the width of the sidewall at an angle of about 45° relative to horizontal, starting at the front edge of said sidewall and sloping downward; and ii) a plurality of shelves, each shelf being substantially flat, each shelf being slidably disposed within the grooves between said pair of sidewalls so that each shelf defines an angle of about 45° relative to horizontal; and iii) wherein said rack system is inserted into the cavity defined in said backpack with the front edge of each said sidewall facing the front wall of said backpack, whereby said shelves slope downward toward the back wall of said backpack and said rack system is adapted for evenly distributing the weight of a load against the back wall of the backpack in order to relieve strain.

11. The backpack rack system according to claim 10, wherein said insertable rack system is made from a substantially rigid, impact resistant synthetic polymer.

12. The backpack rack system according to claim 11, further comprising backpack attachment means for securely attaching the insertable rack system to the backpack.

13. The backpack rack system according to claim 12, further comprising a base member connected between the bottom ends of said pair of sidewalls, whereby said pair of sidewalls are disposed vertically and said base member is disposed horizontally therebetween in order to form a substantially U-shaped frame, and wherein:

a) each of said plurality of shelves has a flange projecting from the edges of the shelf; and b) each of said sidewalls has a plurality of notches defined in the front edge thereof, each notch being aligned with the intersection of one of said plurality of grooves and the front edge, said notch being adapted for receiving one of said flanges, whereby said shelves are grasped by said flange and slide within said grooves, and are prevented from sliding out of said grooves by said flange being received in said notches.

14. The backpack rack system according to claim 12, wherein at least one of said plurality of shelves further comprises a material storage bin, said material storage bin having:

a) a tray having a plurality of compartments defined therein;

b) a lid for covering said plurality of compartments, said lid being hingedly attached to said tray; and c) a resealable fastener connected to said lid and said tray for fastening said lid to said tray.

15. The backpack rack system according to claim 12, further comprising a base member connected between the bottom ends of said pair of sidewalls, whereby said pair of sidewalls are disposed vertically and said base member is disposed horizontally therebetween in order to form a substantially U-shaped frame, and wherein each shelf in said plurality of shelves includes a plurality of ribs spaced over the width of the shelf and extending longitudinally for the length of the shelf.

16. The backpack rack system according to claim 12, wherein:

a) each shelf in said plurality of shelves has a pair of lateral edges, a flange projecting vertically downwards at a right angle from each of the lateral edges of said shelf, and further includes a T-shaped connector extending from the flange; and b) each of the sidewalls further includes a plurality of brackets adapted for receiving said T-shaped connectors, the stem of the T-shaped connector being supported by said brackets, the crossbar of the T-shaped connectors being supported by the grooves defined in the inner surface of said sidewalls, whereby said plurality of shelves removably slides between said pair of sidewalls and each said shelf remains disposed between said pair of sidewalls by friction between said brackets and said T-shaped connectors.

* * * * *